US007556365B2

(12) United States Patent
Stathem

(10) Patent No.: US 7,556,365 B2
(45) Date of Patent: Jul. 7, 2009

(54) INKJET PRINTING SYSTEM WITH COMPLIANT PRINTHEAD ASSEMBLY

(75) Inventor: Ralph L. Stathem, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 395 days.

(21) Appl. No.: 11/387,465

(22) Filed: Mar. 22, 2006

(65) Prior Publication Data

US 2007/0222829 A1 Sep. 27, 2007

(51) Int. Cl.
*B41J 2/175* (2006.01)

(52) U.S. Cl. ..... 347/86

(58) Field of Classification Search ..... 347/85
See application file for complete search history.

(56) References Cited

U.S. PATENT DOCUMENTS

| | | | | |
|---|---|---|---|---|
| 4,279,271 | A | 7/1981 | Neff | |
| 4,342,042 | A | 7/1982 | Cruz-Uribe et al. | |
| 4,677,447 | A | 6/1987 | Nielsen | |
| 5,812,163 | A | 9/1998 | Wong | |
| 5,992,992 | A | 11/1999 | Gibson | |
| 6,003,986 | A | 12/1999 | Keefe | |
| 6,039,443 | A | 3/2000 | Dunphy | |
| 6,132,034 | A | 10/2000 | Miller | |
| 6,170,939 | B1 * | 1/2001 | Ujita et al. | 347/86 |
| 6,209,997 | B1 | 4/2001 | Duong et al. | |
| 6,290,343 | B1 * | 9/2001 | Lewis et al. | 347/85 |
| 6,419,343 | B1 | 7/2002 | Taylor et al. | |
| D466,926 | S | 12/2002 | Miyahara et al. | |
| 6,494,568 | B2 | 12/2002 | Hou et al. | |
| 6,523,579 | B1 | 2/2003 | Tham | |
| 6,626,516 | B2 * | 9/2003 | Tsukuda | 347/35 |
| 6,739,710 | B2 | 5/2004 | Lin et al. | |
| 6,749,295 | B2 | 6/2004 | Kim et al. | |
| 6,761,445 | B2 | 7/2004 | Hoen et al. | |
| 6,773,099 | B2 | 8/2004 | Inoue et al. | |
| 6,799,843 | B2 | 10/2004 | Okamoto | |
| 6,830,321 | B2 | 12/2004 | Okamoto et al. | |
| 6,854,836 | B2 | 2/2005 | Ishinaga et al. | |
| 6,955,423 | B2 | 10/2005 | Rodriquez Mojica et al. | |
| 6,955,425 | B2 | 10/2005 | Childs et al. | |
| 7,246,874 | B2 * | 7/2007 | Hirakata et al. | 347/29 |
| 2002/0036672 | A1 | 3/2002 | Courtney et al. | |

FOREIGN PATENT DOCUMENTS

| | | |
|---|---|---|
| EP | 0 786 346 | 7/1997 |
| EP | 0 855 274 | 7/1998 |

OTHER PUBLICATIONS

PCT International Search Report; Patent Application No. PCT/US2007/063027—filed Mar. 1, 2007. Report issued Nov. 16, 2007.

* cited by examiner

*Primary Examiner*—Stephen D Meier
*Assistant Examiner*—Alexander C Witkowski

(57) ABSTRACT

An inkjet printer including a printhead assembly and an ink supply coupled to the printhead assembly for supplying ink thereto. The printhead assembly may include a compliant chamber and a printhead arranged to receive ink from the compliant chamber. The ink supply may be configured to expand the compliant chamber and then to create a backpressure that contracts the compliant chamber and induces reverse flow from the printhead assembly to the ink supply.

20 Claims, 6 Drawing Sheets

INKJET PRINTING SYSTEM WITH COMPLIANT PRINTHEAD ASSEMBLY

BACKGROUND

Inkjet printers fire droplets of ink from the nozzles of a printhead assembly onto print media. The ink is provided to the printhead assembly from an ink supply. Generally, the pressure in the ink supply should be managed to control ink flow to the printhead assembly. For example, if the ink supply lacks a sufficient backpressure, ink may leak from the nozzles. Alternatively, if the backpressure in the ink supply is excessive, the nozzles may not fire properly. However, even with effective management of the backpressure, gas may accumulate in the printhead assembly. This accumulation may restrict the ability of the printhead assembly to receive ink and to deliver ink to media, thereby reducing print quality and the useful lifespan of the printhead assembly.

DETAILED DESCRIPTION

The present teachings provide a printing system, including method and apparatus, for managing ink and gas using a compliant printhead assembly. The printhead assembly may be coupled to an ink supply for receiving ink therefrom. The printhead assembly may include a compliant chamber and a printhead arranged to receive ink from the compliant chamber. The ink supply may be configured to expand the compliant chamber, such as by pressurization via a pump, to urge ink and gas (generally air trapped in or near the printhead) out of the printhead, thereby priming the printhead. The ink supply then may create a backpressure that contracts the compliant chamber and induces reverse flow of ink and gas (generally air trapped away from the printhead near the top of the assembly) from the printhead assembly to the ink supply. Overall, the printing system of the present teachings may offer substantial advantages over other printing systems, including better pressure control, improved air management, better print quality, longer printhead life, higher flow rates, and/or replaceable ink cartridges with more efficient ink use, among others.

Figure 1:
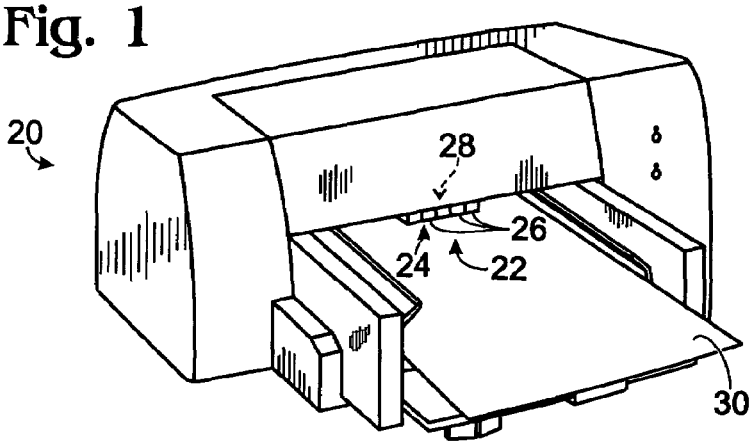
FIG. 1 is a view of an exemplary inkjet printer with a compliant printhead assembly, in accordance with aspects of the present teachings.

FIG. 1 shows an exemplary inkjet printer 20 with a compliant printhead assembly. The printer may include an ink management system 22 that stores ink in ink supplies 24, for example, replaceable cartridges 26. The ink management system also may supply ink to a printhead assembly 28 that delivers the ink to media 30 via the printhead assembly. In other examples, the printer may be any type of apparatus capable of delivering ink (a liquid colorant) to media in a desired pattern. Exemplary printers that may be suitable include desktop printers, portable printers, large-format printers, plotters, photocopy machines, facsimile machines, multi-function peripherals, and/or the like. Furthermore, the printers may be suitable for printing on any suitable media, particularly sheet media. Exemplary media and/or media compositions that may be suitable include paper, cardboard, metal, plastic, wood, fabric, and/or the like.

Figure 2:
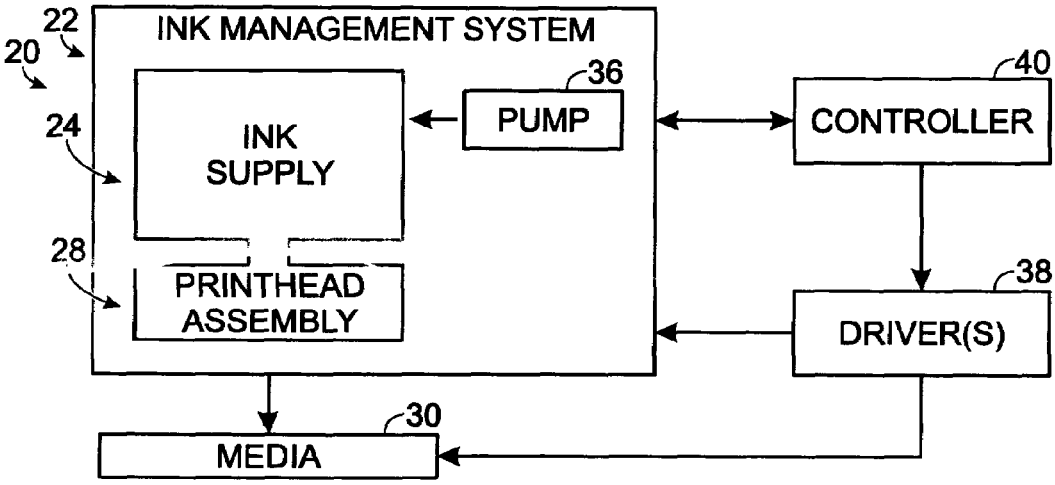
FIG. 2 is a schematic view of the inkjet printer of FIG. 1.

FIG. 2 shows printer 20 in more schematic form. The printer also may include a pump 36, one or more drivers 38, and a controller 40.

Pump 36 may be coupled to any suitable component(s) of the ink management system at any suitable position(s). The pump may be coupled to the ink supply, an upstream ink oasis, the printhead assembly, a position between the ink supply and the printhead assembly, and/or the like. The pump may be coupled continuously or at discrete times as needed to change the pressure within the ink management system. For example, the pump may be coupled via a flexible conduit that allows relative movement of the pump and the coupled component. Alternatively, the pump may be coupled by bringing the pump into engagement with the coupled component, such as by bringing the ink supply to the pump in a service station of a printer (and/or by bringing the pump to the ink supply).

The pump may exert a positive pressure, for example, by supplying a volume of fluid (gas (e.g., air) or liquid) to the management system, or may exert a negative pressure (a backpressure) by removing a volume of the fluid from the management system. Accordingly, the pump may be coupled upstream or downstream of any suitable component, to push or pull ink to or from the component. The pump may be of any suitable type, including bellows, double-diaphragm, flexible impeller, gear, linear, oscillating, peristaltic, piston (e.g., syringe pumps), progressing cavity, and/or rotary pumps, among others.

Driver 38 may be one or more drive mechanisms that drive mechanical motion within the printer. Each drive mechanism may include a motor to provide a driving force. The drive mechanism may drive any suitable movement, such as movement of media relative to the ink management system, movement within the ink management system (e.g., relative movement within and/or between the pump, the ink supply, the printhead assembly, service station, etc.), and/or the like.

Controller 40 may control any suitable components of the printer. For example, the controller may control actuation/operation of each driver, the pump, and/or firing elements in the printhead assembly. Actuation and/or operation may be controlled according to time, frequency, direction, velocity, acceleration, and/or the like. The controller also may receive signals from various components of the printer to monitor operation of the components. For example, the controller may receive signals related to on/off state, position, velocity, volume, temperature, etc. The controller may include a processor, memory, a bus, input/output connections, processing instructions (e.g., hardware, firmware, and/or software), and/or the like.

Figure 3:
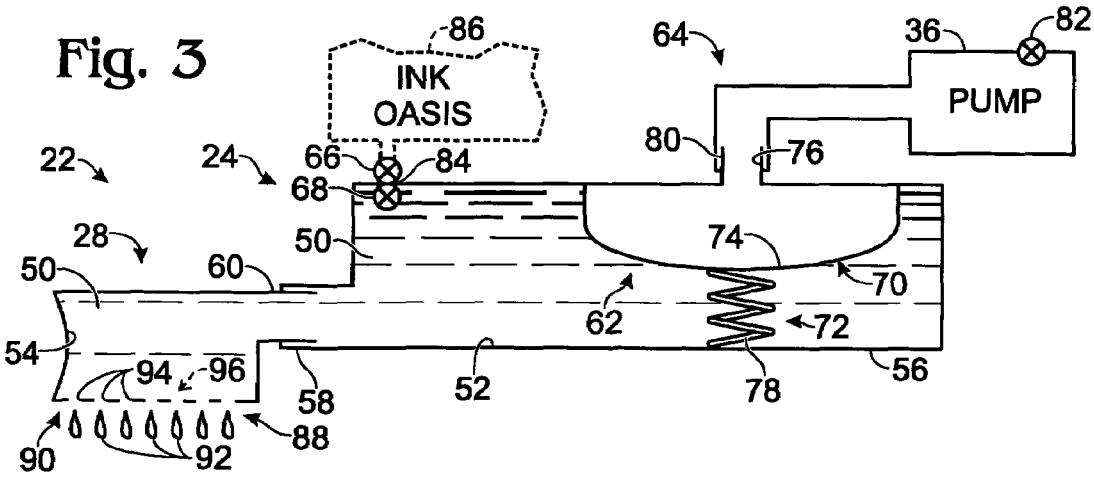
FIG. 3 is a somewhat schematic view of selected portions of the inkjet printer of FIGS. 1 and 2, particularly an ink management system of the inkjet printer.

FIG. 3 shows ink management system 22 in somewhat schematic form. Ink 50 may be disposed in fluid compartments provided by ink supply 24 and printhead assembly 28. For example, the ink supply may include an ink reservoir (a supply chamber) 52 disposed in fluid communication with a compliant chamber 54 of the printhead assembly. The ink reservoir may be substantially larger in volume than the fluid capacity of the printhead assembly, for example, at least about ten-fold greater. The ink supply may be coupled permanently (i.e., configured not to be uncoupled by a user of the printer) or removably (i.e., configured to be uncoupled by a user for replacement, disposal, recycling, servicing, and/or re-filling the ink supply). The ink supply thus may be a modular cartridge including a housing 56 enclosing the ink reservoir. In the present illustration, the ink supply and printhead assembly are coupled directly by coupling structures included in an outlet 58 of the ink supply housing and an inlet 60 of the printhead assembly. In other embodiments, the ink supply and printhead assembly may be spaced by a discrete conduit (s) and/or intermediate ink vessel(s).

Pressure in the ink reservoir may be controlled and/or regulated by various mechanisms. For example, ink supply 24 may include a backpressure or depressurization mechanism 62 to depressurize (to decrease the pressure of) the ink reservoir, such as to impart a backpressure (a net negative pressure relative to outside the ink supply) to the ink reservoir. Alternatively, or in addition, the ink supply may include a pressurization mechanism 64 to increase the pressure of the ink reservoir, such as to impart a net positive pressure to the ink reservoir. Furthermore, the ink supply may include one or more valves, such as valves 66, 68 to regulate and/or restrict communication between the ink reservoir and outside of the ink supply.

Backpressure mechanism 62 may operate to pull on the ink in the ink reservoir. For example, the backpressure mechanism may include a variable-volume (flexible) chamber 70 (generally an air chamber) and a biasing mechanism 72 that urges the flexible chamber to change its volume, generally urging the flexible chamber to contract to a smaller volume. The flexible chamber may be disposed in the ink supply, such as enclosed by housing 56 and having a flexible partition or membrane 74 that partitions the housing to form at least a portion of a wall of the flexible chamber. Changes in the volume of the flexible chamber may be permitted by an opening 76 in the supply housing. The biasing mechanism also may be disposed in the housing and may include a spring 78 or other biasing structure.

Pressurization mechanism 64 may operate to push-prime the printer, by pushing gas out of the printhead assembly, particularly the printhead thereof. The pressurization mechanism also may use flexible chamber 70 or may use a distinct interface with the ink supply. The flexible chamber may be pressurized by pump 36 hermetically coupled to the flexible chamber. For example, housing 56 may include a coupling structure, such as a nipple 80, a socket, a gasket, and/or the like, which may facilitate mating and/or restrict fluid leakage. After pressurization, the flexible chamber may be depressurized to or below atmospheric pressure by uncoupling the pump from the flexible chamber (such as by moving the pump relative to housing 56) and/or by releasing the pressure via a valve 82, among others.

Valves 66, 68 may operate to control fluid communication through an opening or vent 84 of the housing, to determine whether or not fluid enters and/or exits the ink reservoir via the opening. Opening 84 may provide fluid communication between ink reservoir 52 and the ambient atmosphere outside the housing. Accordingly, the opening may control entry (or exit) of air/gas to (or from) the ink reservoir, such as when the ink supply is the upstream terminus (the initial source) of the ink. Alternatively, the opening may control entry (or exit) of ink to (or from) the ink reservoir. For example, in some embodiments, if the ink reservoir is not the upstream terminus of the ink management system, the ink reservoir may be coupled to an upstream ink oasis 86 (shown dashed as an optional component) that supplies ink to the ink reservoir through opening 84.

The valves may have any suitable arrangement and structure. The valves may be coupled to the housing (e.g., both valves inside the housing, both valves outside the housing, and/or the valves disposed on opposing sides of the housing). Alternatively, one or more of the valves may be spaced from the housing, for example, upstream of the ink supply between the ink supply and an ink oasis and/or coupled to the ink oasis. The valves may be arranged in series and/or in parallel. The valves, and particularly movable valve elements thereof, may be formed by distinct components and/or by the same component(s). Furthermore, the valves may have valve seats formed by the same or distinct regions of the same component (e.g., valve seats that are overlapping or nonoverlapping), such as valve seats provided by the housing of the ink supply, and/or may have valve seats provided by distinct components.

The valves may be pressure sensitive. Furthermore, each valve may have a response pressure (a pressure at which the valve opens, closes, and/or adjusts flow rate) determined by fluid pressure alone and/or by a biasing structure, such as a lever and/or spring, among others. Exemplary valves that may be suitable include angle, ball, bubble-generator (gap with a meniscus), butterfly, diaphragm, flapper, gate, globe, needle, pinch, slide, and/or stopcock valves.

Printhead assembly 28 may form the downstream terminus of the ink management system from which ink exits the system. Accordingly, the printhead assembly includes a printhead 88 that is fed by compliant chamber 54. The printhead may include a plurality of nozzles 90 from which ink droplets 92 are fired onto media. The nozzles may be formed by an array of orifices 94 and associated firing elements 96, such as heater and/or piezoelectric elements, among others.

FIGS. 4-8 show an exemplary ink supply 110 for use in an inkjet printer with push priming. The ink supply is coupled (indicated at 112 in FIG. 4) to a downstream printhead assembly, and coupled (or couplable)(indicated at 114 in FIG. 4) to a pump. However, these additional components are omitted from the current views to simplify the presentation.

Ink supply 110 has a housing 116 enclosing an ink reservoir 118 and an air chamber 120. The ink reservoir is disposed in fluid communication with the printhead assembly and adjoins the air chamber. Vent (opening) 122 of the housing provides fluid communication between the ink reservoir and outside the housing, for example, the ambient atmosphere in the present illustration. At least one valve 124 controls this fluid communication. The valve may be biased toward a closed position by a spring 126 or other biasing mechanism. In addition, the air chamber may be operatively and/or mechanically coupled to valve 124 via a lever 128. Furthermore, the air chamber may form part of a backpressure mechanism 130, and of a pressurization mechanism 132 (also see FIG. 3) that can be actuated to override the action of the backpressure mechanism.

The air chamber may have any suitable structure and size. For example, any suitable proportion of the walls of the air chamber may be flexible. In some cases, at least substantially all of the wall structure of the air chamber may be flexible, to form a bag. Alternatively, approximately half or more of the wall structure (by area) may be relatively rigid, that is, resistant to substantial change in shape. In the present illustration (see FIG. 5), an outer wall 134 and inner walls 136, 138 projecting inward from the outer wall form a substantial portion of the surface area of the air chamber. A flexible member, such as sheet 140, may be secured to the inner walls (spaced from the outer wall) to form the flexible portion of the air chamber. In other embodiments, the flexible sheet may be secured adjacent, rather than spaced from, the outer wall. The flexible portion of the air chamber may be inelastic, that is, relatively resistant to an increase in surface area when the air chamber is under pressure, or may be elastic. If formed in part by the housing, the air chamber may include any suitable portion of a selected outer wall of the housing. For example, the air chamber may include over at least about one-half of the surface area of the selected outer wall. Furthermore, the air chamber may be expandable, under normal operating conditions of the printer, to any suitable portion of the entire volume enclosed by the housing, such as at least about one-tenth, one-fifth, one-third, or one-half, among others.

Figure 4:
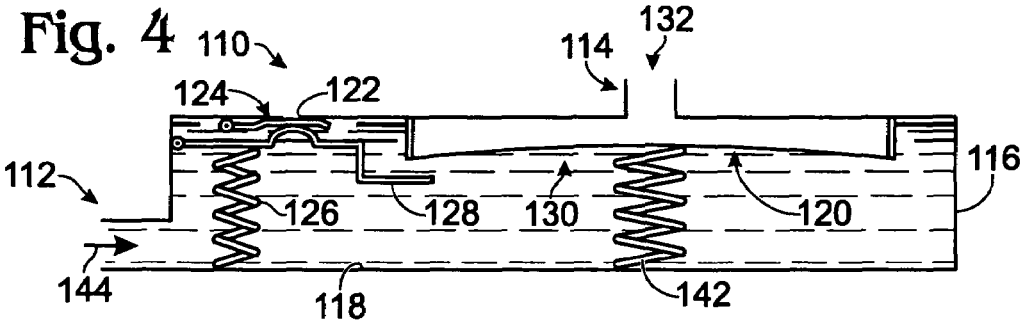
FIG. 4 is a somewhat schematic view of an exemplary ink supply for use in an inkjet printer with a compliant printhead assembly, with the ink supply creating a backpressure, in accordance with aspects of the present teachings.

FIG. 4 shows ink supply 110 substantially full of ink. Air chamber 120 may be somewhat underinflated (i.e., deflated or contracted) and a spring 142 of the backpressure mechanism may be extended to create a backpressure, indicated by an arrow at 144, that urges ink in a direction toward the ink supply from the printhead assembly, to avoid leakage of ink out of the printhead orifices. Furthermore, since the backpressure is not excessive, valve 124 may be closed by spring 126 urging lever 128 against valve 124.

Figure 5:
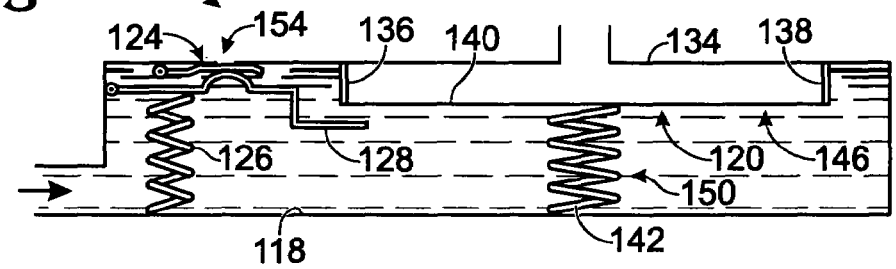
FIG. 5 is another view of the ink supply of FIG. 4, with the ink supply creating a backpressure in the presence of a reduced volume of ink relative to FIG. 4, in accordance with aspects of the present teachings.
Figure 6:
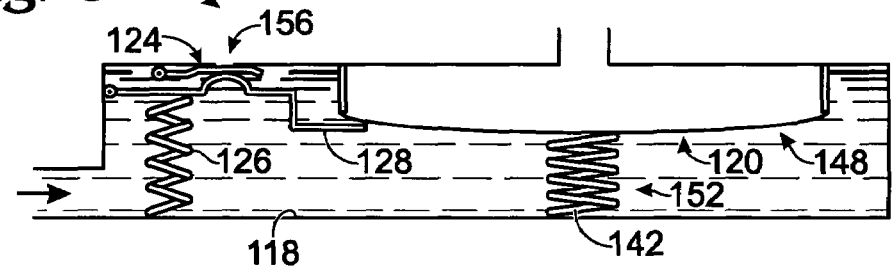
FIG. 6 is still another view of the ink supply of FIG. 4, with the ink supply creating a backpressure in the presence of a further reduced volume of ink relative to FIGS. 4 and 5, in accordance with aspects of the present teachings.

FIGS. 5 and 6 show ink supply 110 with ink reservoir 118 holding reduced volumes of ink relative to the configuration of FIG. 4. Accordingly, air chamber 120 may be relatively expanded, indicated at 146 and 148, respectively, and spring 142 compressed more, indicated at 150 and 152, respectively. However, valve 124 may still be closed, indicated at 154 and 156, respectively, because lever 128 still maintains the valve in the closed position. Although the backpressure may be higher here than in FIG. 4, the backpressure may not be sufficiently high to restrict printhead operation substantially.

Figure 7:
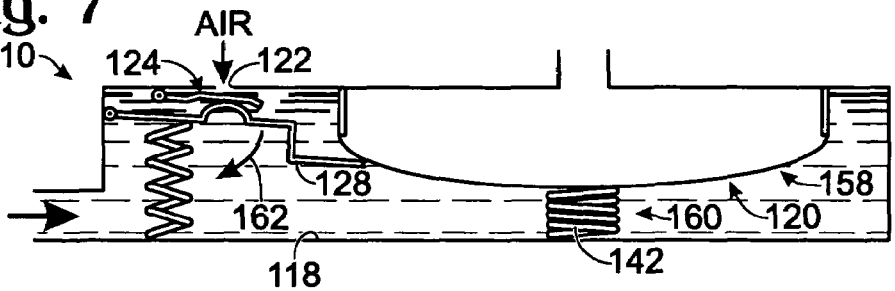
FIG. 7 is yet another view of the ink supply of FIG. 4, with a regulator valve of the ink supply opened to reduce the backpressure by entry of air into the supply through a vent, in accordance with aspects of the present teachings.

FIG. 7 shows ink supply 110 with ink reservoir 118 holding a still further reduced volume of ink relative to the configurations of FIGS. 4-6. Accordingly, air chamber 120 may be expanded still further, indicated at 158, and spring 142 compressed still more, indicated at 160. However, to avoid further increases in the backpressure, lever 128 may be urged away, indicated at 162, from the valve by the position of the air chamber and/or a coupled structure such as spring 142. Valve 124 thus may open so that external air (or ink) can enter the ink reservoir via vent 122, to reduce the backpressure such that the backpressure is regulated within acceptable limits. Once sufficient air/ink is let into the ink reservoir the air chamber may return to a less expanded (less inflated) configuration, such as in any of FIGS. 4-6, and valve 124 should close.

Figure 8:
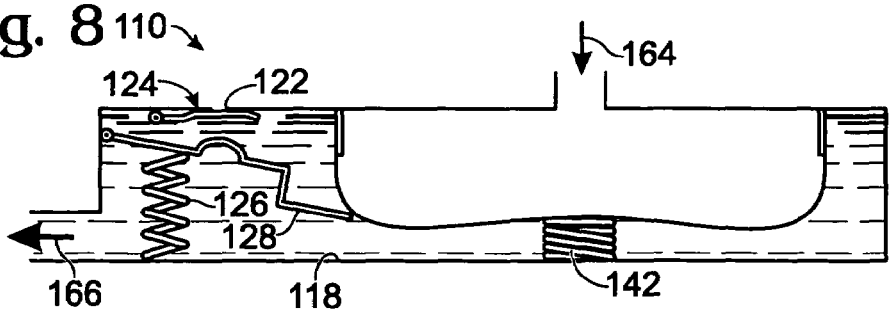
FIG. 8 is still yet another view of the ink supply of FIG. 4, with the ink supply in a push-prime configuration in which the ink supply is pressurized and a check valve of the ink supply is closed to restrict flow of ink out of the vent, in accordance with aspects of the present teachings.

FIG. 8 shows ink supply 110 in a push-prime configuration in which the ink reservoir is pressurized. In particular, a pump may be actuated and/or coupled to the ink supply and a volume of gas (and/or fluid) introduced, indicated at 164, into the air chamber to expand/inflate the chamber additionally from the configuration of FIG. 7. Accordingly, the net pressure in the ink reservoir may change from a backpressure to a positive pressure, indicated by the arrow at 166, which also may pressurize the printhead assembly. The additional expansion of the air chamber may urge lever 128 farther away from the valve, such that the valve is not biased toward a closed position by the lever. However, valve 124 also may operate as a check valve responsive to a net positive pressure in the ink reservoir and thus may close upon pressurization of the ink reservoir, to restrict flow of ink out of vent 122. Release of the positive pressure (for example by uncoupling from the pump) may allow the backpressure mechanism to deflate the air chamber and restore a backpressure (as in FIGS. 4-7). The regulation (FIGS. 4-7) and check (FIG. 8) functions of valve 124 may be performed by only one valve or by at least two valves disposed in series (e.g., see FIGS. 12-18).

Figure 9:
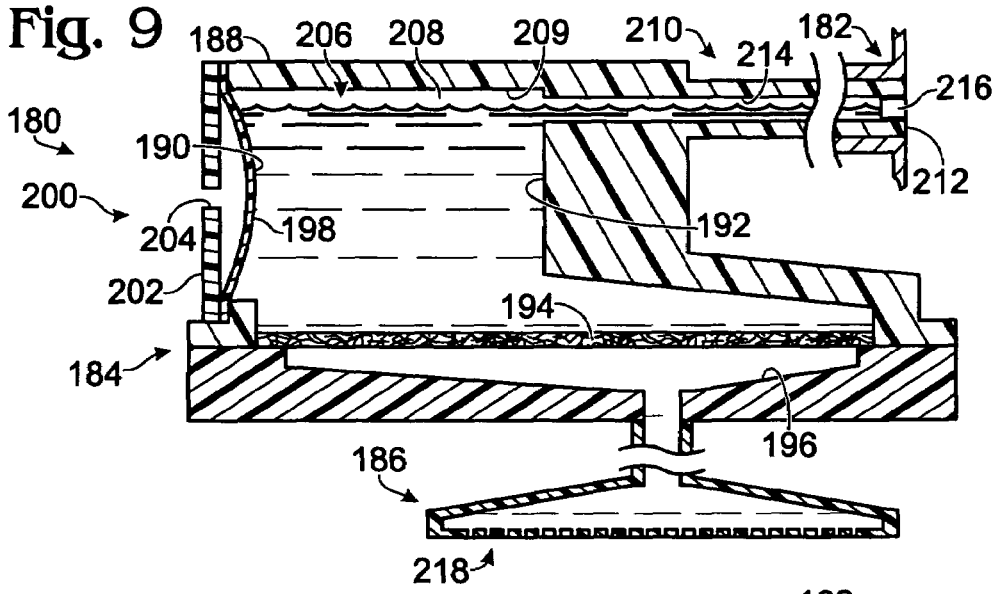
FIG. 9 is a sectional elevation view of an exemplary compliant printhead assembly for use in an inkjet printer, with a compliant chamber of the assembly in a contracted configuration, in accordance with aspects of the present teachings.
Figure 10:
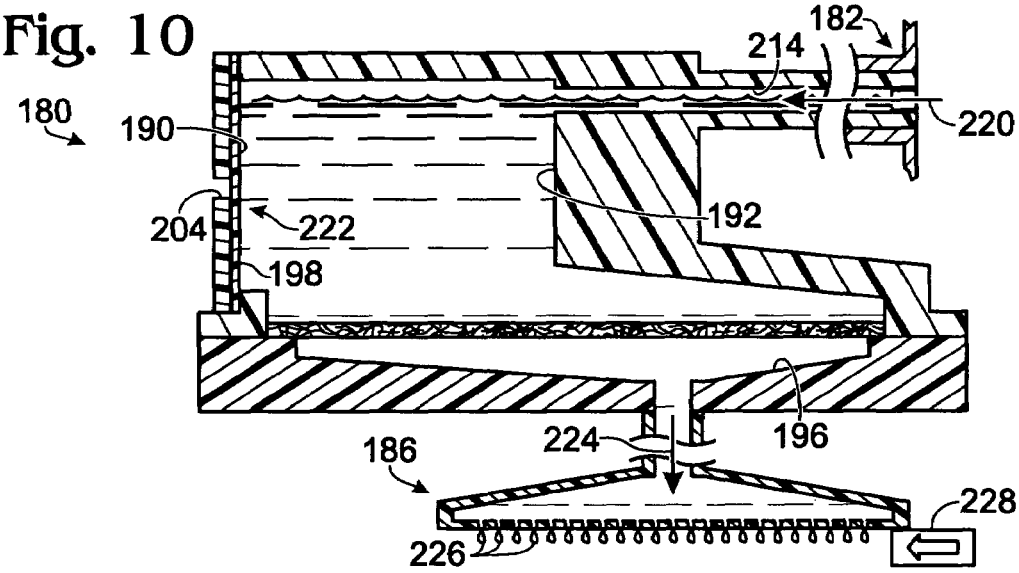
FIG. 10 is a sectional elevation view of the printhead assembly of FIG. 9, with the compliant chamber expanded (pressurized) during a push-prime operation, in accordance with aspects of the present teachings.
Figure 11:
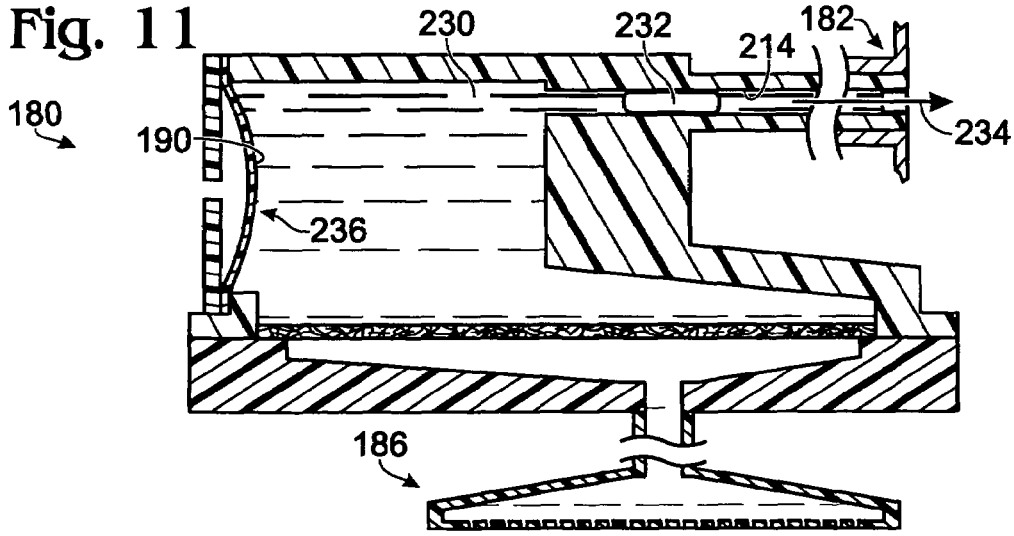
FIG. 11 is a sectional elevation view of the printhead assembly of FIG. 9, with the compliant chamber returning to the contracted configuration of FIG. 9 via reverse flow of ink and gas, in accordance with aspects of the present teachings.

FIGS. 9-11 show an exemplary printhead assembly 180 for use in an inkjet printer with push priming. Printhead assembly 180 may be coupled to an ink supply 182 having a backpressure mechanism and also a pressurization mechanism that can be actuated selectively. The backpressure and pressurization mechanisms may function as described elsewhere in the present teachings (e.g., in relation to FIGS. 4-8). However, these pressure control mechanisms (and most of the ink supply) are omitted from the present figures to simplify the presentation.

Printhead assembly may include a body 184 and a printhead 186 connected to the body (see FIG. 4). The printhead may be mounted fixedly and/or nonremovably to the body. Alternatively, the printhead may be configured to be coupled to and uncoupled from the body, such as for printhead servicing or replacement. Furthermore, the printhead may be disposed in any position relative to the body. For example, the printhead may be disposed generally adjacent the base (or top) of the body, for firing ink droplets downward (or upward) onto a horizontal medium surface. Alternatively, the printhead may be disposed to the side (laterally) of the body, for firing ink droplet sideways onto a vertical medium surface.

Body 184 may have a housing 188 including one or more fluid compartments that serve as a vessel for holding ink and/or gas. For example, the body may include a compliant chamber 190 of variable volume. The compliant chamber may be formed in any suitable portion of the housing, may have any suitable volume, and may have any suitable range and direction of compliance. In the present illustration, the compliant chamber is formed in a plenum region 192 above a filter 194 (e.g., for removing particulates from the ink as the ink moves through the body to the printhead) and above a standpipe region 196 between the filter and the printhead. However, alternatively or in addition, the compliant chamber may be formed in the standpipe region.

The compliant chamber may be configured to expand and contract, to hold a greater or lesser volume of fluid (ink and gas). In some examples, the compliant chamber may be restricted in its ability to expand in response to a change from a neutral pressure (same inside and outside the chamber) to a positive pressure (greater inside than outside), relative to its ability to contract in response to a change from a neutral to a negative pressure (greater outside than inside). In other examples, the compliant chamber may be restricted in its ability to contract in response to a change from a neutral pressure (same inside and outside the chamber) to a negative pressure (greater outside than inside), relative to its ability to expand in response to a change from a neutral to a positive pressure (greater inside than outside).

The compliant chamber may have walls formed by the housing and/or by a compliant member 198. The compliant member may be, for example, a flexible member or sheet secured to the housing. The flexible member may be secured inside a wall of the housing, over a wall of the housing, and/or to cover an opening 200 of the housing. In some examples, the movement of the flexible member may be restricted selectively in one of two opposing directions. In particular, body 184 may include a barrier or wall 202 disposed outward (or inward) of the flexible member. The barrier may restrict outward (or inward) movement of the flexible member selectively relative to inward (or outward) movement. For example, starting with a neutral configuration of the flexible member, barrier 202 may engage the flexible member to restrict outward movement of the barrier (and thus expansion of the compliant chamber)(see FIG. 10). The spacing between the barrier and the flexible member in the neutral configuration may determine the extent to which the flexible member can move outward in response to pressurization of the compliant chamber. By contrast, starting from the neutral configuration of the flexible member, the flexible member may move inward (e.g., to the concave configuration shown in FIGS. 9 and 11) to contract the compliant chamber. One or more openings 204 in the barrier may allow air to move through the barrier as the flexible member moves inward and outward. The flexible member may be elastic or relatively inelastic. In some examples, the flexible member may be planar under a neutral pressure condition. In some examples, the flexible member may be elastic and nonplanar (e.g., flexed inward or outward) under a neutral pressure condition, to provide an asymmetric change in volume in response to positive and negative pressure changes.

Body 184 also may include a ceiling compartment 206 for accumulation of gas, particularly air 208 (see FIG. 9). The ceiling compartment may be disposed adjacent a ceiling 209 within the body, below which gas may accumulate by gravity-driven movement. Accordingly, the ceiling compartment may be disposed in fluid communication with the compliant chamber and generally forms an upper region of the fluid compartment within body 184. The ceiling compartment may overlap partially or completely with the volume enclosed by the compliant chamber and/or may be nonoverlapping with the compliant chamber.

Body 184 further may include an inlet 210 through which fluid may move between the ink supply and the fluid compartment of the printhead assembly. The inlet may provide a coupling structure 212 for connection of the printhead assembly to the ink supply. Furthermore, the inlet may define a channel 214 through which fluid may travel from the ink supply to the printhead assembly. The channel may adjoin the ceiling compartment and extend therefrom to the ink supply. Positioning the channel at about the same level as the ceiling compartment, such that the channel adjoins the ceiling compartment, may facilitate removal of gas (e.g., air) from the printhead assembly, as described below. The inlet further may include a gas-restrictive element 216 disposed in the channel. The gas-restrictive element may be an orifice element or needle, among others, with one or more orifices or pores small enough to restrict gas entry into the body. Restriction of gas entry may facilitate maintaining a backpressure in the printhead assembly if the assembly is disconnected from the ink supply, thereby restricting leakage of ink from the printhead.

FIG. 9 shows the printhead assembly in a ready configuration for firing nozzles 218 of the printhead. Compliant chamber 190 may be in a relatively contracted configuration, with flexible member 198 pulled inward by a backpressure exerted on the compliant chamber by the backpressure mechanism of the ink supply. The extent to which the volume of the compliant chamber is reduced may be determined by the size of the backpressure, the size of the chamber and flexible member, the degree of flexibility and/or elasticity of the flexible member, and/or the like.

FIG. 10 shows the printhead assembly with the ink supply pressurized by the pump. A volume of ink flows, indicated by an arrow at 220, through inlet channel 214 from an ink reservoir of the ink supply upstream, in response to the pressurization. A first portion of the volume of ink may expand the compliant chamber by pushing flexible member 198 outward, indicated at 222. A remaining second portion of the volume of ink may be urged out of the printhead, indicated by an arrow at 224 and producing external ink 226, to drive trapped gas out of the printhead and thus prime the printhead. The printhead may be wiped by a wiper 228 during and/or after pressurization of the printhead assembly. Wiping the printhead may help to prevent mixing of ink of different colors from nozzles connected to different ink compartments and/or to dislodge and remove gas bubbles that may otherwise be drawn back through the orifices by re-entry of ink from outside the printhead. (With a suction prime rather than a push-prime, the suction device may interfere with wiping.) The system may be configured such that any suitable proportion of the transferred ink volume drives expansion of the compliant chamber versus outflow from the printhead. In exemplary embodiments, the compliant chamber may expand by at least about one-tenth, one-fourth, or one-half the transferred volume.

FIG. 11 shows the printhead assembly after the pressurization of the ink supply and printhead assembly has been discontinued. The backpressure mechanism in the ink supply may reduce the pressure in the ink reservoir of the ink supply such that pressure drops toward the ink reservoir from the printhead assembly. Accordingly, ink 230 and gas 232 may be urged out inlet channel 214 in a reverse flow, indicated by an arrow at 234, to the ink reservoir. Compliant chamber 190 may accommodate the reverse flow by contracting regionally, indicated at 236. Air that accumulates in upper portions of the printhead assembly by various mechanisms thus may be moved back to the ink supply so that the air doesn't interfere with operation of the printhead, overcoming the bubble pressure enforced by the gas-restrictive element. (In some embodiments, the bubble pressure may be about one to five inches.) The air in the ink supply may be removed by displacing the air from the ink supply with ink (e.g., by re-filling the ink supply) and/or may be discarded along with the ink supply if the ink supply is replaced.

Figure 12:
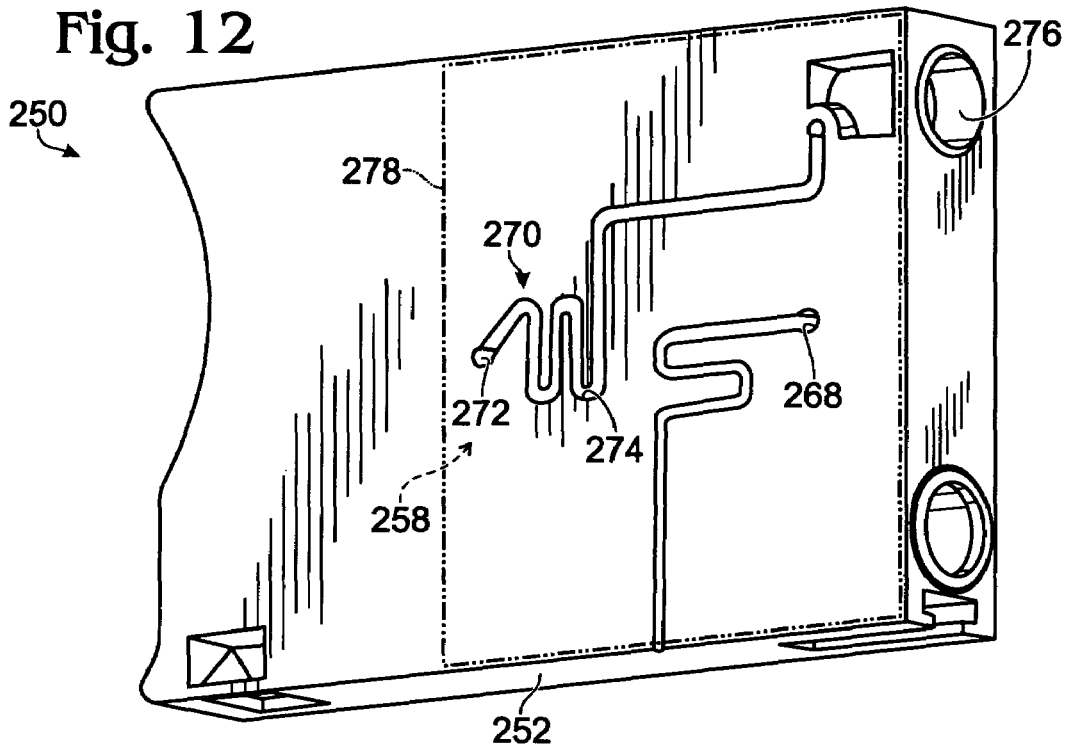
FIG. 12 is a view of an exemplary ink cartridge for use in an exemplary inkjet printer with a compliant printhead assembly, in accordance with aspects of the present teachings.
Figure 13:
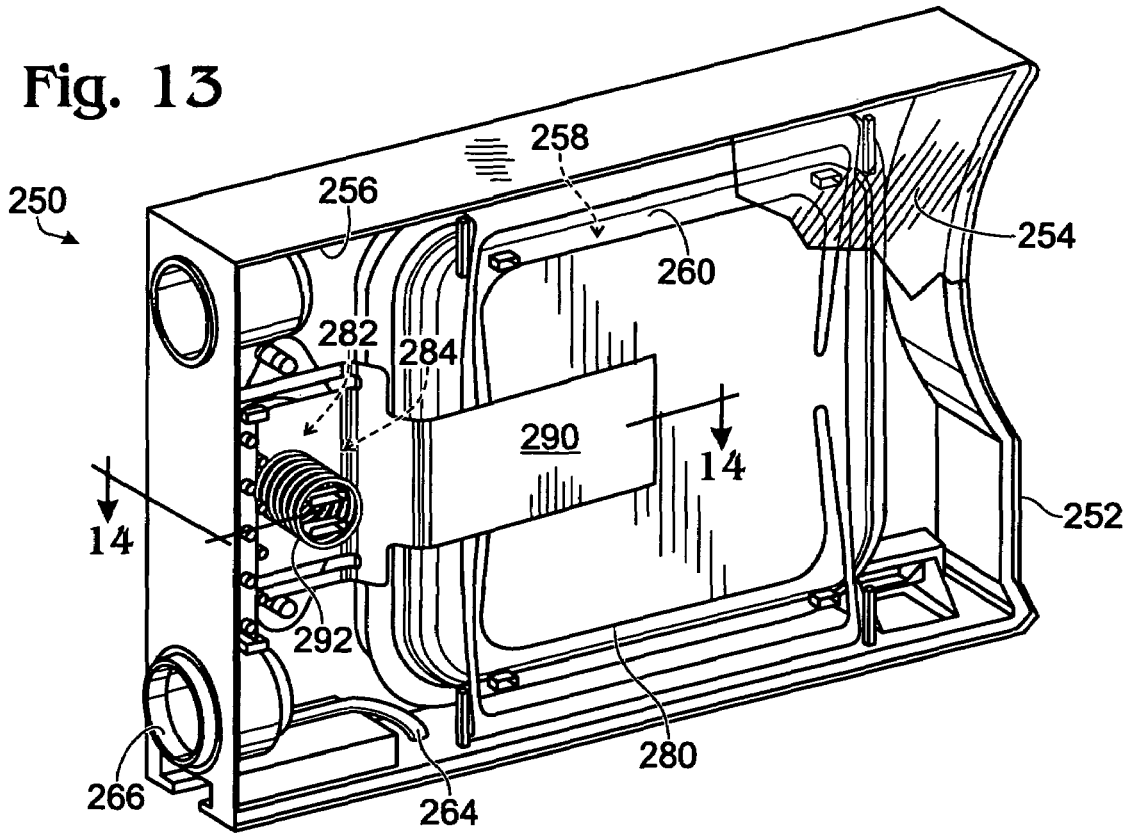
FIG. 13 is a view of the ink cartridge of FIG. 12 taken generally from an opposing side of the cartridge.
Figure 14:
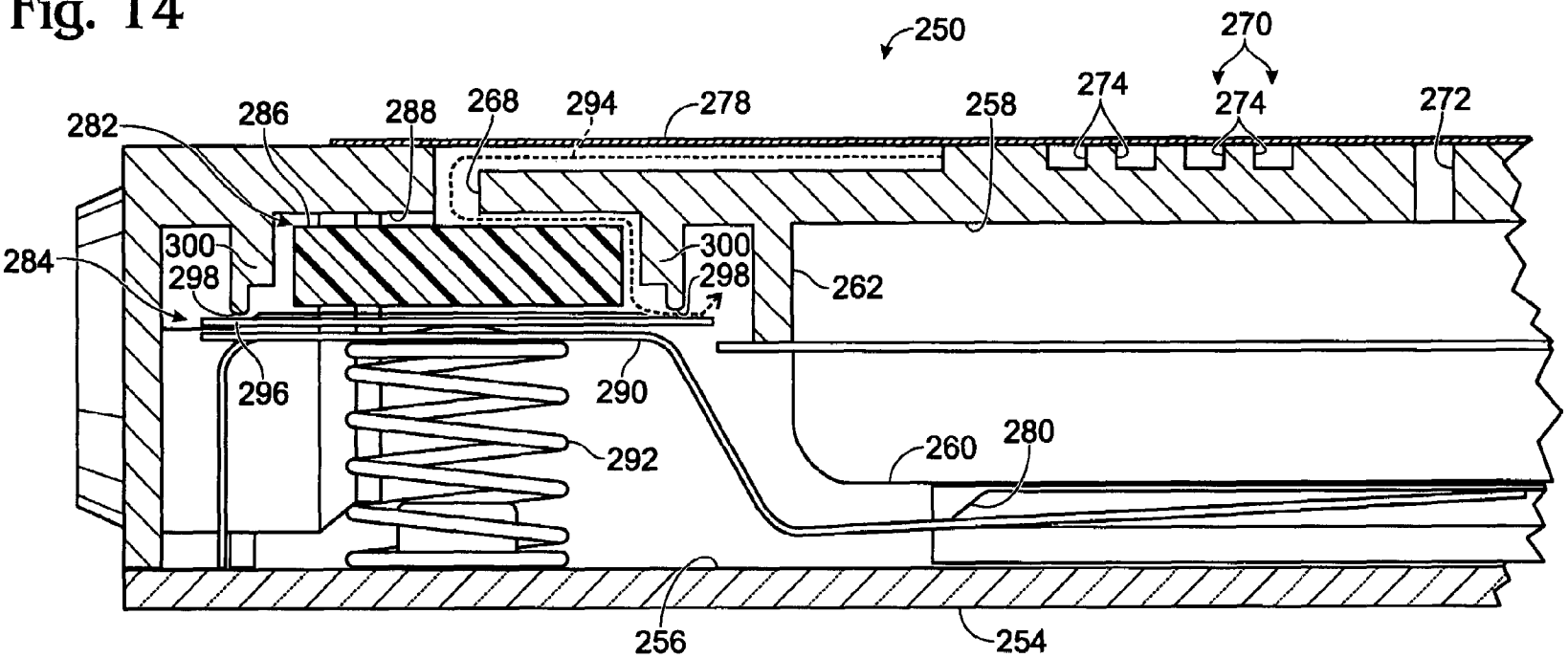
FIG. 14 is a sectional view of the ink cartridge of FIGS. 12 and 13, taken generally along line 14-14 of FIG. 13, with both valves of the cartridge in an open configuration.

FIGS. 12 and 13 show opposing sides of an exemplary ink cartridge 250 for use as an ink supply in a push-primed inkjet printer; FIG. 14 shows a sectional view taken through a portion of the cartridge. Cartridge 250 may include a housing 252 forming the outer walls of the cartridge, including a light-transmissive outer wall 254 (a fragmentary portion is visible in FIG. 13) that permits the level of ink in the cartridge to be visible to a user from outside the cartridge.

The housing may enclose an ink reservoir 256 and an air chamber 258 of variable volume. The ink reservoir and air chamber may share a common wall 260 formed by a flexible member that partitions the housing. The flexible member may be staked to an inner wall 262 of the housing (see FIG. 14).

Ink may exit the ink reservoir via a siphon tube 264 that extends from a base region of the ink reservoir to a coupling 266 of the housing (see FIG. 13). The coupling may be configured to be engaged with an inlet coupling of a printhead assembly to allow fluid to pass between the ink cartridge and the printhead assembly. Ink and/or gas also may enter the ink reservoir via the siphon tube from the printhead assembly and/or via an opening or vent 268 defined by the housing (see FIGS. 12 and 14). A pair of valves that control access to opening 268 is described further below.

Air chamber 258 may communicate with the ambient atmosphere and/or a pump via a vent 270 (see FIGS. 12 and 14). The vent may include a hole 272 defined by the housing and a surface channel 274 extending from the hole to a pump coupling 276. The surface channel may be formed by the exterior surface of the housing and a covering, such as film or tape 278 affixed to the exterior housing over the surface channel to enclose the surface channel. The surface channel may follow a tortuous path to provide a labyrinth that limits water vapor loss.

The air chamber may form part of a backpressure mechanism (see FIGS. 13 and 14). The backpressure mechanism may include a leaf spring 280 engaged with the flexible wall of the air chamber and with the housing. The leaf spring may urge the air chamber toward deflation.

Fluid communication between ink reservoir 256 and opening 268 may be controlled by a pair of valves 282, 284 arranged in series (see FIGS. 13 and 14).

Valve 282 may be a regulator valve. The regulator valve may include a movable valve element 286 that engages an outer valve seat 288 from by an interior surface of the housing's outer wall (see FIG. 14). Regulator valve element 286 may be urged against valve seat 288 by a lever 290. The lever may be connected to the housing, operatively coupled to leaf spring 280 (and thus the air chamber), and biased by another spring 292. Expansion of the air chamber thus may urge the leaf spring against the lever to permit regulator valve element 286 to disengage the outer valve'seat and thus allow external air to enter the ink reservoir, along a path indicated by a dashed arrow at 294 in FIG. 14.

Valve 284 may be a check valve disposed inward of regulator valve 282. Check valve 284 may include a check valve element 296 (e.g., a flap) that provides a flapper valve. The flapper valve (or at least a central portion of the valve) may be pre-loaded toward a closed position (engagement with an inner valve seat 298) by the spring. Furthermore, pressurization of the ink reservoir may cause check valve element 296 to continue to engage the inner valve seat formed by inner walls 300 of the housing disposed inward of and lateral to and/or around outer valve seat 288 for the regulator valve. Check valve element 296 may be flexible and/or more flexible than the regulator valve element. Accordingly, the perimeter region of the check valve element may respond to pressure differences, independent of the spring position, to engage the inner valve seat upon pressurization and to disengage with a backpressure.

The use of a pair of valves arranged in series to control fluid communication may offer substantial advantages over the use of a single valve to respond to backpressure and pressurization. For example, the valves may be designed to be responsive to distinct pressure differences and thus may have a finer and/or more easily adjusted control of valve actuation, fluid movement, and pressure regulation.

Figure 15:
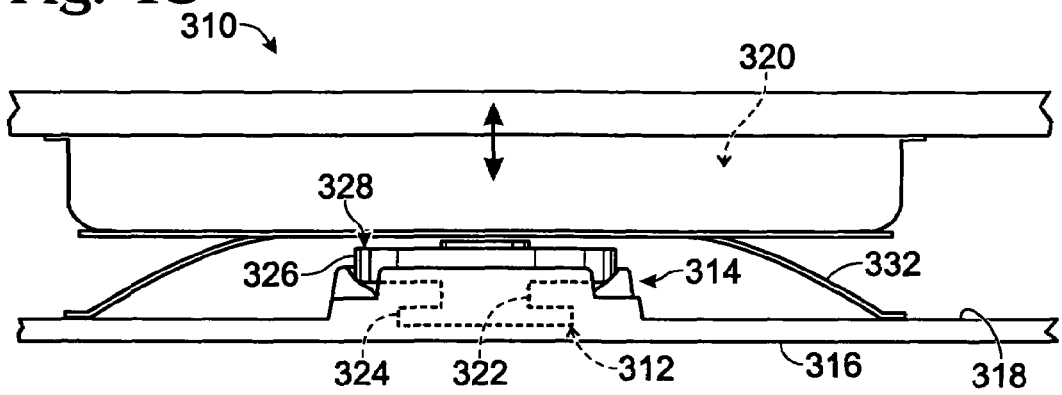
FIG. 15 is a fragmentary view of another exemplary ink cartridge for use in an exemplary inkjet printer with a compliant printhead assembly, in accordance with aspects of the present teachings.

FIG. 15 shows a sectional view of an exemplary ink cartridge 310 including a regulator valve 312 and a check valve 314 arranged in series. Valves 312 and 314 may be used in any suitable ink supply in place of a single valve and/or in place of the pair of valves described above (see FIGS. 12-14). The valves may be coupled to a housing 316 of the cartridge enclosing an ink reservoir 318 and an air chamber 320. The valves may control communication between the ink reservoir and an opening 322 that communicates with outside the housing.

Valves 312 and 314 may have respective valves elements 324, 326 formed by a shared valve body 328. The valve body may extend through opening 322, such that valve elements 324 and 326 are disposed adjacent opposing sides of the opening. The valve body may be unitary or formed of two or more attached pieces.

The valve body may be operatively coupled to the air chamber such that the valve body is urged outward by sufficient expansion of the air chamber. For example, the valve body may be positioned to be engaged by a leaf spring 332 (urging deflation) if the air chamber becomes sufficiently inflated.

Figure 16:
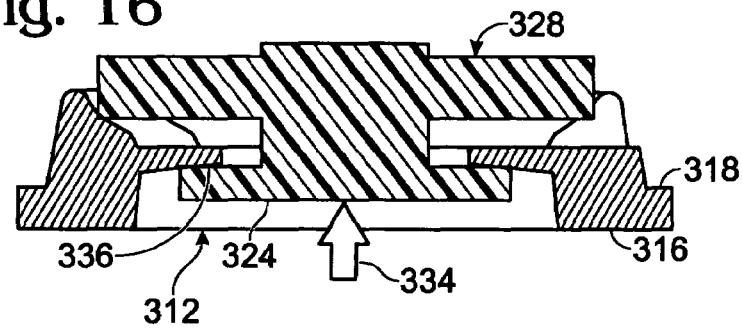
FIG. 16 is a sectional view of selected portions of the ink cartridge of FIG. 15, particularly a check valve and a regulator valve of the cartridge, with the regulator valve closed, in accordance with aspects of the present teachings.

FIG. 16 shows a configuration of valve body 328 produced with a backpressure below a threshold backpressure for opening regulator valve 312. The valve body may be urged inward by a backpressure, indicated by an open arrow at 334, such that valve element 324 engages an outer valve seat 336 to close the valve and block flow of fluid between the outside and inside of the ink reservoir. Air chamber 320 may not be expanded sufficiently at this backpressure for the leaf spring to be pushed against the valve body.

Figure 17:
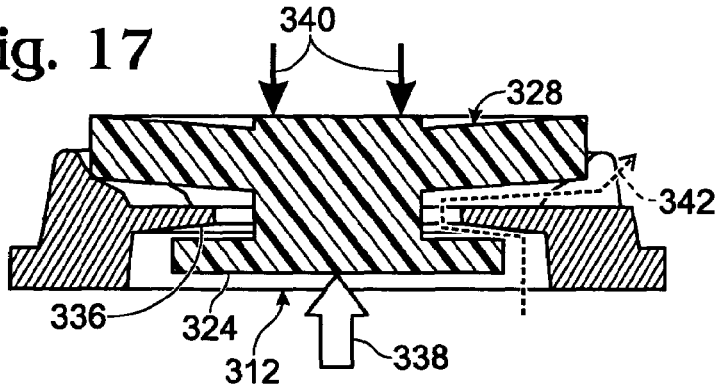
FIG. 17 is a sectional view of the selected portions of the ink cartridge of FIG. 16, with both valves open.

FIG. 17 shows a configuration of valve body 328 produced with a backpressure at or above a threshold backpressure for opening regulator valve 312. The valve body may be urged inward by an increased backpressure, indicated by an open arrow at 338. However, air chamber 320 may be expanded sufficiently to push leaf spring 332 (see FIG. 15) against the valve body, indicated by solid arrows at 340 in FIG. 17. The valve element 324 thus disengages outer valve seat 336 to open the valve and permit flow of fluid (e.g., ink or air) into the ink reservoir, indicated by a dashed arrow at 342. When sufficient fluid has entered the ink reservoir, the air chamber deflates sufficiently to no longer urge the valve body into the open position for regulator valve 312.

Figure 18:
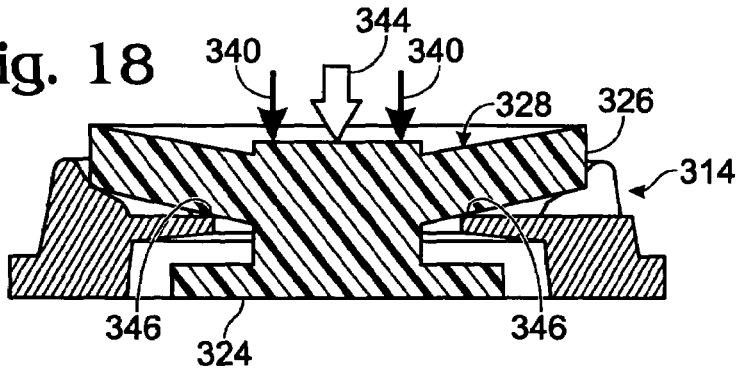
FIG. 18 is a sectional view of the selected portions of the ink cartridge of FIG. 16, with the check valve closed.

FIG. 18 shows a configuration of valve body 328 produced by pressurization of the ink reservoir. Valve element 324 may be urged toward the open position by engagement of leaf spring 332 against the valve body, indicated by solid arrows at 340. However, a positive pressure in the ink reservoir relative to outside the housing, indicated by an outwardly directed open arrow at 344, may deform valve body 328 such that check valve element 326 engages an inner valve seat 346, to close the valve.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

What is claimed is:

1. An apparatus, comprising:

a printhead assembly including a compliant chamber and a printhead arranged to receive ink from the compliant chamber; and an ink supply coupled to the printhead assembly for supplying ink thereto, the ink supply being configured to expand the compliant chamber and then to create a backpressure that contracts the compliant chamber and induces reverse flow from the printhead assembly to the ink supply.

2. The apparatus of claim 1 , further comprising a pump that pressurizes the ink supply and the compliant chamber.

3. The apparatus of claim 1, wherein the ink supply is a replaceable cartridge.

4. The apparatus of claim 1, wherein the compliant chamber includes a flexible wall, and wherein the printhead assembly further includes a barrier disposed outward of the flexible wall and configured to restrict expansion of the compliant chamber.

5. The apparatus of claim 1, wherein the compliant chamber has a volume when pressure inside the compliant chamber is the same as outside the compliant chamber, and wherein the volume changes more when the pressure becomes negative than when the pressure becomes positive.

6. The apparatus of claim 1, wherein the printhead is attached nonremovably to the compliant chamber.

7. The apparatus of claim 1, wherein the printhead assembly includes a ceiling compartment in fluid communication with the compliant chamber and positioned for gravity-driven accumulation of gas, and wherein the printhead assembly also includes an inlet configured to receive ink for the printhead assembly from the ink supply, the inlet being arranged such that the reverse flow urges gas out of the ceiling compartment, thereby removing gas from the printhead assembly.

8. A printhead assembly for ink delivery from an inkjet printer, comprising:

a printhead; and a body connected to the printhead and configured to receive ink from an upstream ink supply for delivery to media from the printhead, the body including a compliant chamber for holding a variable volume of ink, a ceiling compartment in fluid communication with the compliant chamber and positioned for gravity-driven accumulation of gas, and an inlet configured to receive ink for the body from the ink supply and to permit a reverse flow of fluid from the body to the ink supply, the inlet being positioned such that the reverse flow urges gas out of the ceiling compartment, thereby removing gas from the body.

9. The printhead assembly of claim 8, wherein the printhead and the body form an integrated unit.

10. The printhead assembly of claim 8, wherein the compliant chamber includes a flexible wall, and wherein the body includes a barrier disposed outward of the flexible wall and configured to restrict expansion of the compliant chamber.

11. The printhead assembly of claim 8, wherein the compliant chamber has a volume when pressure inside the compliant chamber is the same as outside the compliant chamber, and wherein the volume changes more when the pressure becomes negative than when the pressure becomes positive.

12. The printhead assembly of claim 8, wherein the compliant chamber and the ceiling compartment overlap.

13. The printhead assembly of claim 8, wherein the inlet includes an inlet coupling that allows coupling to and uncoupling from the ink supply, and wherein the inlet defines a channel extending from the ceiling compartment to an exterior of the body, and wherein the inlet includes a gas-restrictive structure configured to restrict gas movement through the channel relative to liquid movement, thereby restricting entry of air into the body if the inlet coupling is uncoupled from the ink supply.

14. The printhead assembly of claim 8, wherein the body includes a filter disposed between the compliant chamber and the printhead.

15. A method of removing gas from a printhead assembly, comprising:

pressurizing a compliant chamber of a printhead assembly disposed in fluid communication with an upstream ink supply such that the compliant chamber expands; and depressurizing the compliant chamber such that the compliant chamber contracts, allowing fluid to flow in reverse from the compliant chamber to the ink supply, thereby transferring gas from the printhead assembly to the ink supply.

16. The method of claim 15, wherein the ink supply includes an ink reservoir and an air chamber disposed adjacent the ink reservoir, and wherein pressurizing includes operating a pump that expands the air chamber.

17. The method of claim 15, wherein the ink supply includes a backpressure mechanism, and wherein depressurizing is performed, at least in part, by operation of the backpressure mechanism.

18. The method of claim 15, wherein pressurizing urges ink to exit a printhead of the printhead assembly, further comprising wiping the printhead during and/or after pressurizing and before depressurizing.

19. The method of claim 15, wherein pressurizing is initiated under control of a controller.

20. The method of claim 15, wherein pressurizing includes coupling a pump to the ink supply before pressurizing, operating the pump, or both.

* * * * *